US007410315B2

(12) United States Patent
Nakayama

(10) Patent No.: US 7,410,315 B2
(45) Date of Patent: Aug. 12, 2008

(54) PAPER DISCHARGE MECHANISM FOR A PRINTER, AND A PRINTER

(75) Inventor: Hiroyuki Nakayama, Shiojiri (JP)

(73) Assignee: Seiko Epson Corporation (JP)

( * ) Notice: Subject to any disclaimer, the term of this patent is extended or adjusted under 35 U.S.C. 154(b) by 300 days.

(21) Appl. No.: 11/080,686

(22) Filed: Mar. 14, 2005

(65) Prior Publication Data

US 2005/0200681 A1 Sep. 15, 2005

(30) Foreign Application Priority Data

Mar. 12, 2004 (JP) ..... 2004-071030

(51) Int. Cl.

| | |
|---|---|
| ***B41J 11/66*** | (2006.01) |
| ***B41J 13/02*** | (2006.01) |
| ***B41J 13/076*** | (2006.01) |
| ***B41J 13/28*** | (2006.01) |
| *B41J 2/01* | (2006.01) |

(52) U.S. Cl. ..... 400/621; 400/636; 400/641; 347/104

(58) Field of Classification Search ..... None
See application file for complete search history.

(56) References Cited

U.S. PATENT DOCUMENTS

| | | | | |
|---|---|---|---|---|
| 7,093,933 | B2 * | 8/2006 | Tsuji et al. | 347/104 |
| 7,114,804 | B2 * | 10/2006 | Nunokawa | 347/104 |
| 2003/0160385 | A1 * | 8/2003 | Furusawa | 271/220 |

FOREIGN PATENT DOCUMENTS

| | | | |
|---|---|---|---|
| JP | 56132255 | A * | 10/1981 |
| JP | 61-204450 | | 8/1986 |
| JP | 62-171635 | | 7/1987 |
| JP | 01192664 | A * | 8/1989 |
| JP | 07-149013 | | 6/1995 |
| JP | 2000-062966 | | 2/2000 |
| JP | 2001-178353 | | 6/2001 |
| JP | 2001-199615 | | 7/2001 |
| JP | 2002-346976 | | 4/2002 |
| JP | 2003-118187 | | 4/2003 |
| JP | 2004-071030 | | 7/2003 |

* cited by examiner

*Primary Examiner*—Daniel J Colilla
(74) *Attorney, Agent, or Firm*—Baker & Hostetler, LLP

(57) ABSTRACT

A printer having a paper discharge mechanism which reliably prevents recording paper after completion of the printing operation from being pulled back inside the printer. The printer includes a paper feed roller 62 located on the upstream side of the printing position 83 along the horizontal paper transportation path of the printer. A paper cutting mechanism 67 is located downstream from the printing position. A pressure roller 66 presses the recording paper against a discharge roller 65 from the top side of the paper transportation path. A reversing-prevention lever 80 is disposed coaxially and freely rotatably to the pressure roller 66. The center of gravity of the reversing-prevention lever 80 is downstream from the axis of rotation 66*e* of the pressure roller 66, and the weight of the reversing-prevention lever 80 causes the reversing-prevention lever 80 to contact the top of the discharged paper 10. If the trailing end of the cut and discharged paper 100, which rests on top of the leading end of the roll paper 10, moves with the leading end of the roll paper 10 when the roll paper 10 is pulled back inside the printer after cutting, the trailing end of the discharged paper 100 contacts the reversing-prevention lever 80 and is thus prevented from being pulled back inside the printer.

7 Claims, 6 Drawing Sheets

PAPER DISCHARGE MECHANISM FOR A PRINTER, AND A PRINTER

BACKGROUND OF THE INVENTION

1. Field of Technology

The present invention relates to a paper discharge mechanism for a printer that prevents recording paper discharged by a discharge roller from being pulled back into the printer by the discharge roller, and relates more particularly to a printer paper discharge mechanism that is suitable for use in a roll paper printer arranged to print on roll paper and then cut and discharge the printed paper.

2. Description of Related Art

Roll paper printers typically have a paper cutting mechanism and a discharge roller disposed downstream from the printing position where the print head is located. After printing, the printed paper tape is then cut to a certain length, and the cut length of paper is then discharged by the discharge roller. After discharging the paper, the paper tape is wound back inside the printer in order to position the leading end of the paper for the next printing operation. Roll paper printers having this type of paper cutting mechanism are taught, for example, in Japanese Unexamined Patent Appl. Pub. 2002-346976 and Japanese Unexamined Patent Appl. Pub. 2003-118187.

To assure that the cut off end of the recording paper is completely discharged from the printer, the paper discharge operation continues until the trailing end of the cut paper passes the discharge roller. As a result, the leading end of the paper roll left after cutting off the printed end also extends a specific distance on the discharge side of the nipping portion of the discharge roller. If multiple discharged slips have accumulated in the discharge area, or if the paper is discharged at an angle, the leading end of the roll paper delivered downstream from the discharge roller may be inserted below one or more pieces of discharged paper. This can result in the discharged paper resting on top of the exposed leading end of the roll paper coming with the leading end of the paper tape when the paper is then pulled back inside the paper transportation path, resulting in the discharged paper being nipped and pulled by the discharge roller back into the transportation path. The discharged paper may thus be pulled by the reversing discharge roller back inside the printer when the roll paper is reversed for repositioning for the next printing operation.

Furthermore, thus pulling discharged paper back inside the printer can cause a paper jam.

While sensors can be used to detect the leading end of the paper tape that is pulled back into the printer, the sensor is unable to find the leading edge if the leading edge of the paper is overlapped by the discharged paper that is also pulled back inside. The leading end of the paper therefore cannot be correctly positioned for the next printing operation.

SUMMARY OF THE INVENTION

The present invention is directed to solving the foregoing problems, and an object of the invention is to provide a paper discharge mechanism for a printer that can reliably prevent discharged paper from being pulled back inside the printer by the discharge roller.

The paper discharge mechanism of the present invention is adapted for use in a printer and comprises a discharge roller disposed at a position downstream in the recording paper transportation direction from the recording paper printing position; a pressure roller configured to press against the discharge roller from above; and a reversing-prevention lever configured to prevent discharged paper from being drawn back to the nipping portion of the discharge roller and pressure roller. The reversing-prevention lever is disposed on the downstream side in the paper transportation direction from the nipping portion, and rotates freely around the axis of rotation of the pressure roller, and has a center of gravity which is on the downstream side in the paper transportation direction from said axis of rotation.

The reversing-prevention lever is of a weight which causes the reversing-prevention lever to contact the top of the paper on the downstream side of the nipping portion of the discharge roller. When the recording paper is completely discharged after being cut, the reversing-prevention lever separates from the surface of the paper and rests on the surface of the trailing roll paper. If the trailing end of the discharged paper is on top of the leading end of the roll paper and thus moves back with the roll paper when the discharge roller is reversed to pull the leading end of the roll paper back inside the printer, the trailing end of the discharged piece of paper contacts the reversing-prevention lever. As a result, the discharged piece of paper is prevented from being nipped by the discharge roller and pulled back inside the printer.

Furthermore, a force pushing the reversing-prevention lever away from the recording paper acts on the reversing-prevention lever when discharging the recording paper or roll paper, and the reversing-prevention lever thus exerts very little resistance to movement of the roll paper or recording paper in the forward direction. However, when the recording paper is reversed and pulled back into the printer, a force works in the opposite direction to press the reversing-prevention lever against the surface of the paper, and the reversing-prevention lever thus presses reliably against the surface of the recording paper. The discharged paper is thus reliably prevented from being pulled back inside the printer.

When a plurality of pressure rollers are coaxially disposed widthwise to the printer, the reversing-prevention lever is preferably arranged to be freely rotatably relative to each of the pressure rollers. The discharged paper is more reliably prevented from being drawn back inside the printer when the reversing-prevention lever is located where the nipping portion of the discharge roller and pressure roller can nip the discharged paper than when the reversing-prevention lever is located between the individual pressure roller units.

Further preferably, the paper discharge mechanism also comprises a limiting member configured to limit how far the reversing-prevention lever can rotate due to the weight of the reversing-prevention lever. The space between the print head and platen can generally be opened in a printer for easy recovery from paper jams and other problems, and the discharge roller and pressure roller relatively move in opposite directions in conjunction with this opening action. If the freely rotating reversing-prevention lever moves of its own weight from directly below the pressure roller to a position on the upstream side in the paper transportation direction when the discharge roller separates from the pressure roller, the reversing-prevention lever will be located on the opposite side when the discharge roller is again pressed to the pressure roller, and the reversing-prevention lever will not function. Rotation of the reversing-prevention lever is therefore desirably limited in rotation to prevent this problem.

When the reversing-prevention lever is attached to the pressure roller, the pressure roller preferably comprises a flat, spindle-shaped roller body, a cylindrical bearing formed in unison with and passing through the center of the roller body, and a rotating shaft that is a coil spring inserted freely rotatably inside the cylindrical bearing; and the reversing-prevention lever comprises a pressure roller mounting channel to which the pressure roller can be inserted from a direction perpendicular to the axis of rotation, an inside surface supported freely rotationally by the outside surface of the cylindrical bearing of the pressure roller installed to the pressure roller mounting channel, and a contact portion able to contact the limiting member.

The printer according to the present invention comprises a print head; a paper feed roller disposed upstream in the paper transportation direction from the printing position of the print head, and a paper pressure roller for pressing against the paper feed roller; the foregoing paper discharge mechanism disposed downstream in the paper transportation direction from the printing position; and a paper cutting mechanism disposed between the printing position and the paper discharge mechanism.

Thus comprised, discharged paper is not pulled back inside the printer by the paper discharge mechanism. Problems caused by the discharged paper being pulled back inside the printer, including paper jams and problems repositioning the recording paper after printing, can thus be reliably prevented.

The paper discharge mechanism includes a freely rotating reversing-prevention lever located at a position on the discharge side of the discharge roller in the printer so that the reversing-prevention lever contacts the surface of the discharged recording paper due to the weight of the reversing-prevention lever. This prevents such problems as paper jams and being unable to position the recording paper for the next print operation due to discharged paper being pulled back inside the printer.

The paper discharge mechanism according to another aspect of the present invention comprises a discharge roller pair, including a first roller and a second roller, disposed at a position downstream in the recording paper transportation direction from the recording paper printing position; and a reversing-prevention lever configured to prevent discharged paper from being drawn back to the nipping portion of the discharge roller pair; wherein the first roller and the second roller are arranged in vertical direction, and wherein the reversing-prevention lever is disposed on the downstream side in the paper transportation direction from the nipping portion, and rotates freely around the axis of rotation of the upper one of the first and second rollers with the center of gravity of the reversing-prevention lever on the downstream side in the paper transportation direction from said axis of rotation.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of an inkjet printer according to the present invention is described below with reference to the accompanying figures.

Figure 1:
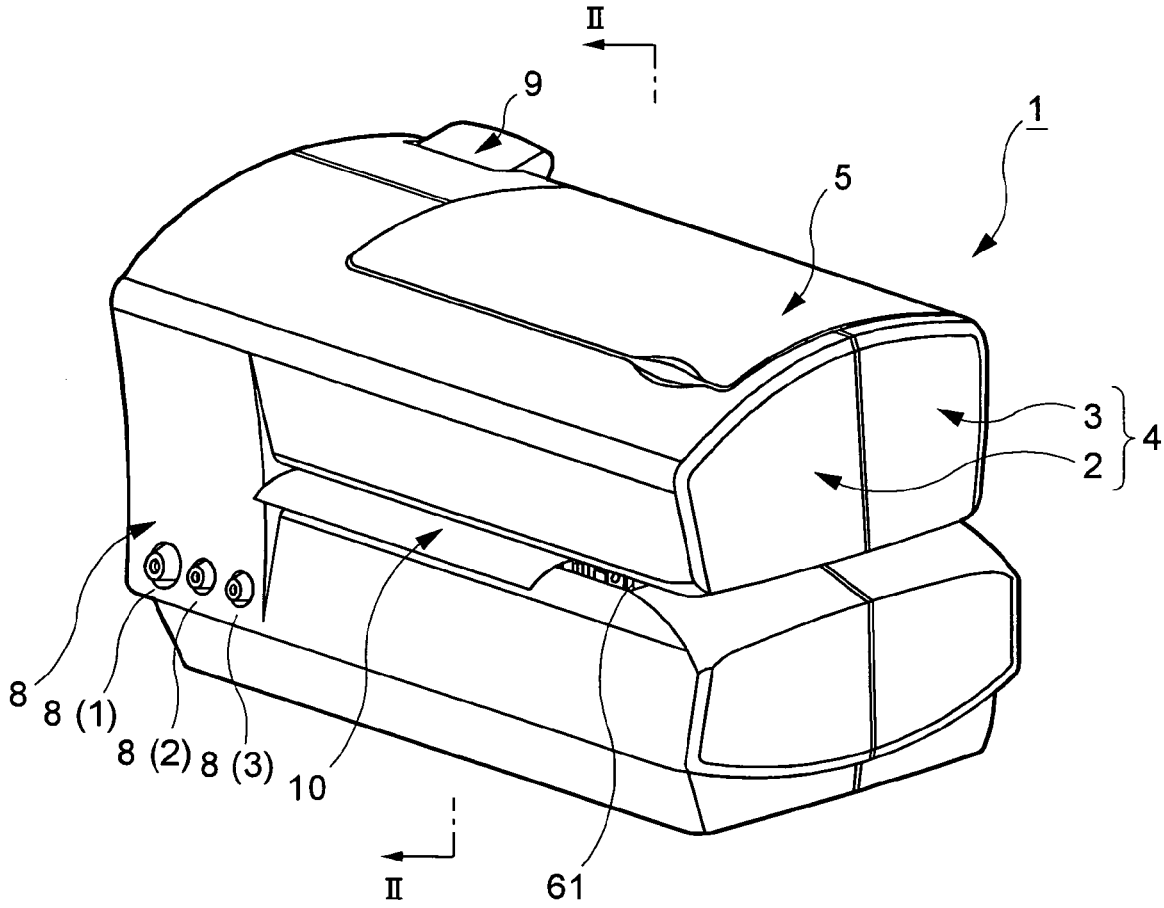
FIG. 1 is an oblique external view of an inkjet printer according to a preferred embodiment of the invention.

As shown in FIG. 1, the inkjet printer 1 has a printer case 4 and an openable cover 5 attached to open and close to the top part of the printer case 4. The printer case 4 has a front case portion 2 and a back case portion 3. Opening the cover 5 exposes the ink cartridge loading unit 6 for loading an ink cartridge 7. An operating panel 8 having a plurality of operating buttons 8(1) to 8(3) is provided at one side of the front case portion 2. A platen lever 9 for opening and closing the platen is disposed at the back of the back case portion 3.

At approximately the vertical center of the printer case 4, the front case portion 2 and back case portion 3 are each separated into top and bottom portions except in the area of the operating panel 8. A substantially horizontal paper transportation path for conveying the recording paper 10 from the back to the front of the printer is formed between the top and bottom portions of the front case portion 2 and back case portion 3. The transportation path is open on the opposite side of the printer as the operating panel 8 so that paper exceeding the width of the transportation path can be inserted to and conveyed through the paper transportation path for printing. A sheet feeder or roll paper holder (not shown in the figure) is commonly connected to the back of the inkjet printer 1, and the inkjet printer 1 prints on single sheets or roll paper while conveying the paper 10 from the back out through the front of the inkjet printer 1. A roll paper holder (not shown) is connected to the back of the inkjet printer 1 for supplying a tape of recording paper 10 in this embodiment of the invention.

Figure 2:
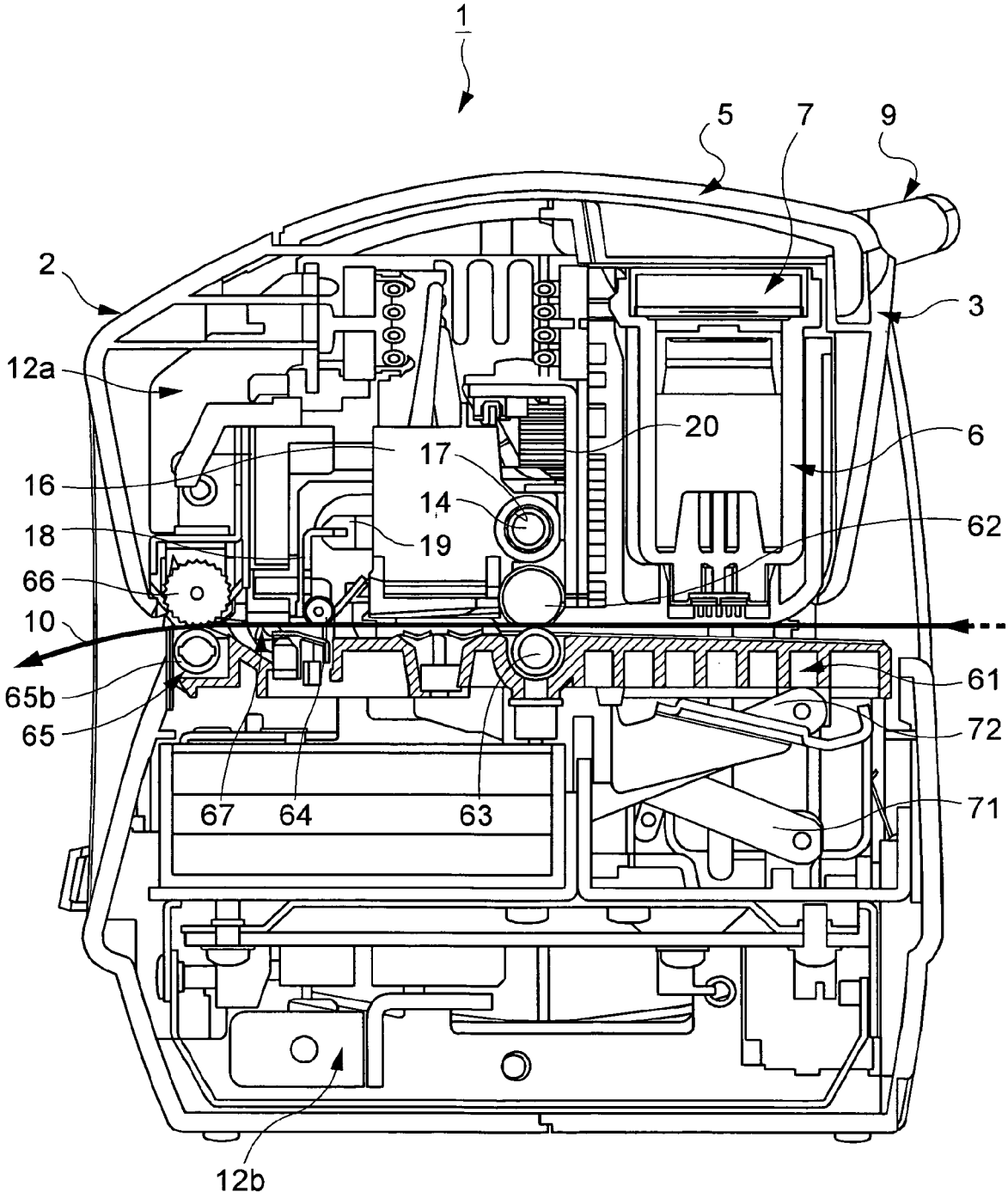
FIG. 2 is a section view of the inkjet printer of FIG. 1 taken along the lines II-II of FIG. 1.
Figure 4:
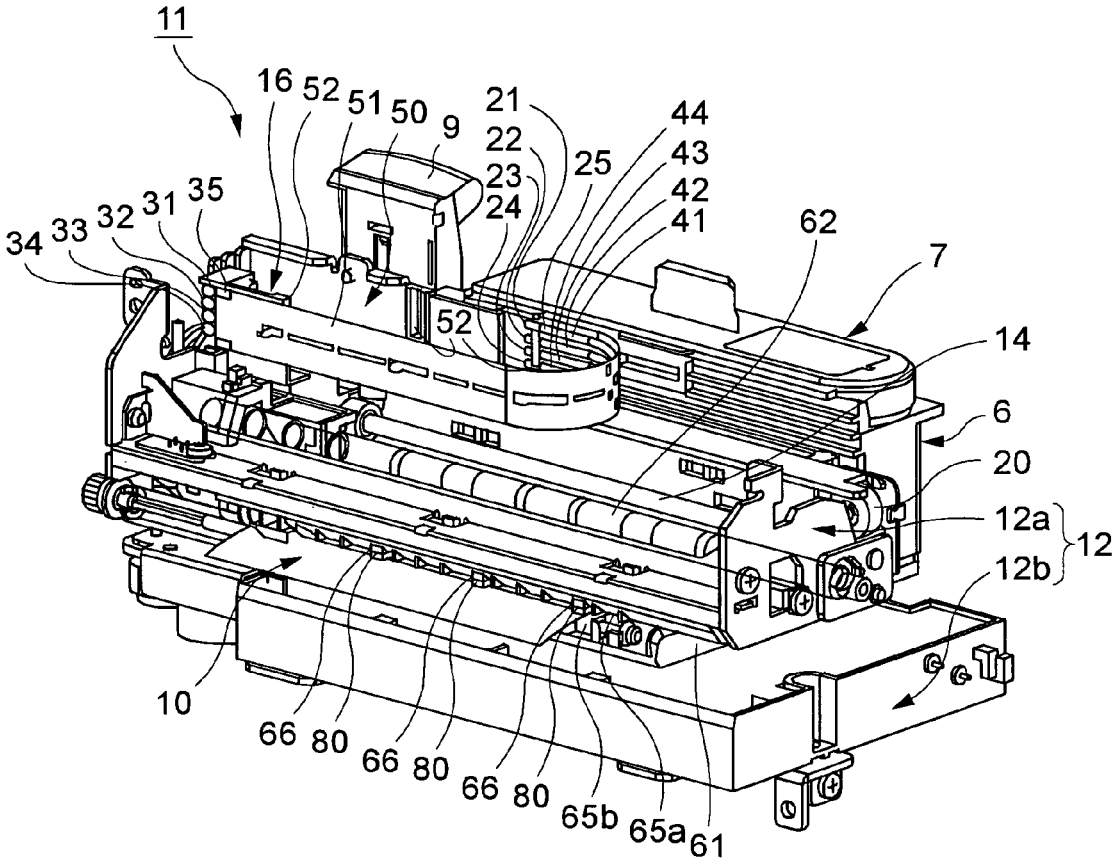
FIG. 4 is an oblique view of the main printing unit in the inkjet printer shown in FIG. 1.

As shown in FIG. 4, the main printing unit 11 contained inside the printer case 4 has a flat U-shaped chassis 12 that is open on one side. A guide shaft 14 is disposed along the width of the printer in the top portion 12*a* of the chassis 12. A carriage 16 on which the inkjet head 15 is mounted travels bidirectionally along this guide shaft 14. More specifically, as shown in FIG. 2, a guide hole 17 through which the guide shaft 14 passes and slides freely are formed on the back side of the carriage 16, and a guide member 19 projecting from the front of the carriage 16 support and enable the carriage 16 to slide freely along a guide frame 18 that is rendered along the width of the printer in front of the carriage 16.

A timing belt 20 is also mounted along the width of the printer behind the path along which the carriage 16 travels. The carriage 16 is linked to this timing belt 20 so that when a carriage motor (not shown) drives the timing belt 20, the carriage 16 can be conveyed along the guide shaft 14 bidirectionally along the width of the printer.

The ink cartridge loading unit 6 is located behind the timing belt 20, and ink is supplied to the inkjet head 15 from an ink cartridge 7 installed in the ink cartridge loading unit 6. An ink cartridge 7 containing cyan, magenta, yellow, and black ink is used in this embodiment, and each color of ink is supplied from the ink cartridge 7 to the inkjet head 15 through one of four separate ink supply paths.

Four stationary ink tubes 21 to 24 for supplying the different colors of ink lead from the front part of the ink cartridge loading unit 6. Four moving ink tubes 31 to 34 leading from the inkjet head 15 mounted on the carriage 16 are fixed to the carriage 16. Four flexible ink tubes 41 to 44 connect the stationary ink tubes 21 to 24 to the moving ink tubes 31 to 34. The stationary ink tubes 21 to 24 and flexible ink tubes 41 to 44 are connected by a first tube connector 25, and the moving ink tubes 31 to 34 and flexible ink tubes 41 to 44 are connected by a second tube connector 35. An ink tube holding mechanism 50 having a flexible tape 51 and a plurality (three in this embodiment) of tube holders 52 holds the four flexible ink tubes 41 to 44 bundled together in a flexible tape.

The recording paper transportation mechanism for conveying the paper 10 from the back to the front of the printer passed the printing position of the inkjet head 15 is described next.

The transportation path is defined in this embodiment by a platen 61 disposed below and opposite the inkjet head 15, which is installed to the carriage 16 facing downward. Paper feed roller 62 is disposed widthwise to the printer at a position behind the printing position of the platen 61 opposite the inkjet head 15, and paper pressure roller 63 presses the paper against the paper feed roller 62 from below. The inkjet head 15 prints to the paper 10 as the paper 10 is conveyed between these rollers 62 and 63 to the front of the printer. After printing, the paper 10 is conveyed forward by guide roller 64. Discharge roller 65 is disposed at the front end portion of the platen 61, and pressure roller 66 applies pressure to the discharge roller 65 from above. After printing, the paper 10 is discharged to the front of the printer by these rollers 65 and 66.

A paper cutting mechanism 67 is also disposed between the guide roller 64 and pressure roller 66. The paper cutting mechanism 67 has a stationary blade 67*a* fixed on the platen 61 side, and a rotary blade 67*b* located above the stationary blade 67*a*. When the carriage 16 moves bidirectionally widthwise to the printer after printing is completed, the rotary blade 67*b* moves along the stationary blade 67*a* and thus cuts the paper 10 across the width of the paper.

The platen 61, which sets the printing position of the inkjet head 15, is supported horizontally by the chassis bottom portion 12*b* so that the platen 61 can move vertically in this embodiment of the invention. More specifically, the platen 61 is supported by links 71, 72 and a coil spring (not shown in the figure) disposed compressed between the chassis bottom portion 12*b* and platen 61. The links 71, 72 are connected in an X between the chassis bottom portion 12*b* and platen 61. The paper pressure roller 63 and discharge roller 65 are assembled to the platen 61. When the platen 61 is lowered from the height shown in the figure, the transportation path opens and recording paper can be easily inserted from the front, back, or side to the transportation path.

The platen 61 can be lowered and opened by pushing down on the platen lever 9. The platen lever 9 is linked to the platen 61 by a cam mechanism having an eccentric cam, for example. Pushing down on the platen lever 9 again after lowering the platen 61 by means of the platen lever 9 releases the platen 61 from being held in the down (open) position so that the force of the spring returns the platen 61 to the up (closed) position for conveying the paper 10.

Discharge Mechanism

A reversing-prevention lever 80 is attached to the pressure roller 66, which is pressed against the discharge roller 65. After the paper is cut by the paper cutting mechanism 67 and the paper is discharged from the nipping portion of the rollers 65 and 66, this reversing-prevention lever 80 prevents the paper from being drawn back inside the printer. The discharge roller 65, pressure roller 66, and reversing-prevention lever 80 together constitute the paper discharge mechanism in this embodiment of the invention.

Figure 3:
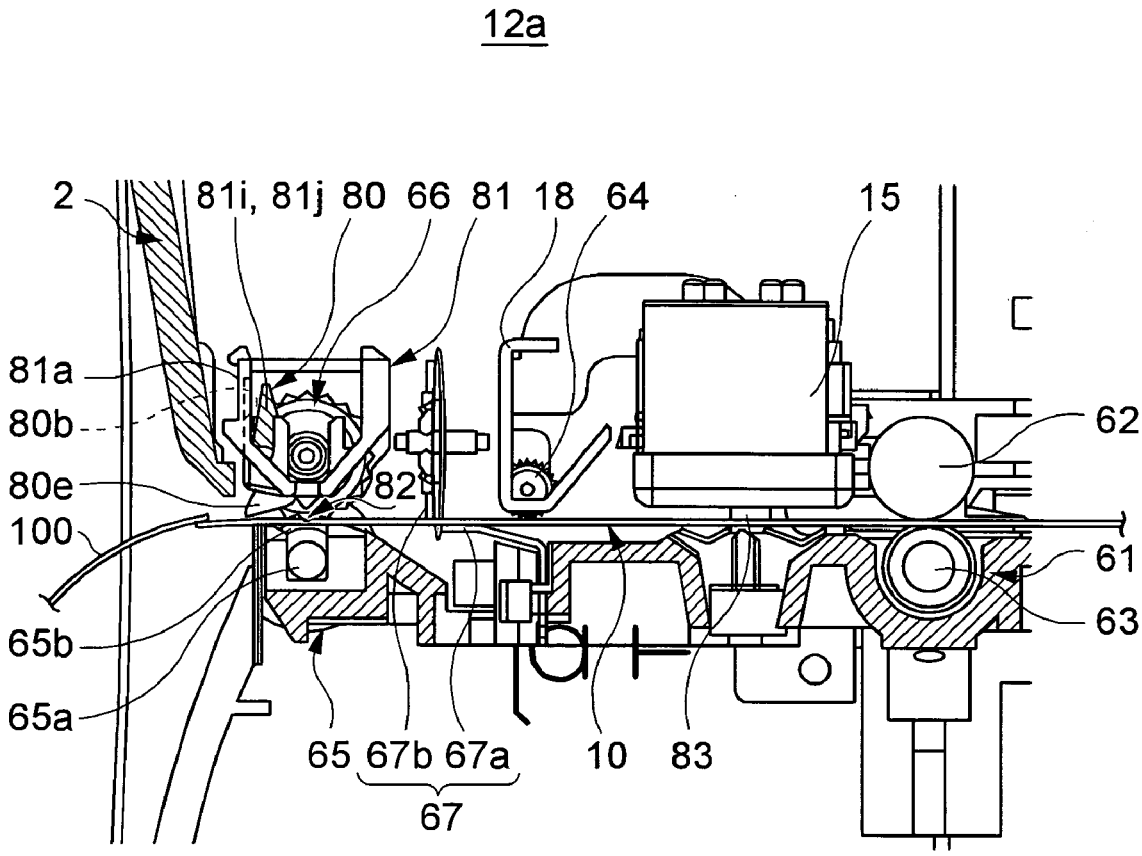
FIG. 3 is an enlarged section view showing a part of the section shown in FIG. 2.

Referring to FIG. 2 to FIG. 4, the discharge roller 65 has a roller shaft 65*a* disposed widthwise to the printer at the front portion of the platen 61, and a plurality of roller units 65*b* fixed coaxially to the roller shaft 65*a* with a specific gap between the roller units. The discharge roller 65 is rotationally driven simultaneously to the paper feed roller 62 by the paper feed motor (not shown in the figure) that rotationally drives the paper feed roller 62.

The pressure roller 66 presses against the discharge roller 65 from a position vertically above the discharge roller 65 and also includes multiple coaxially disposed roller units disposed at positions corresponding to the roller units 65*b* of the discharge roller 65.

The reversing-prevention lever(s) 80 are disposed coaxial to the roller units of the pressure roller 66 in an arrangement permitting the reversing-prevention lever(s) 80 to freely rotate about the respective axis of rotation 66*e* of each of the roller units of the pressure roller 66.

Figure 5A:
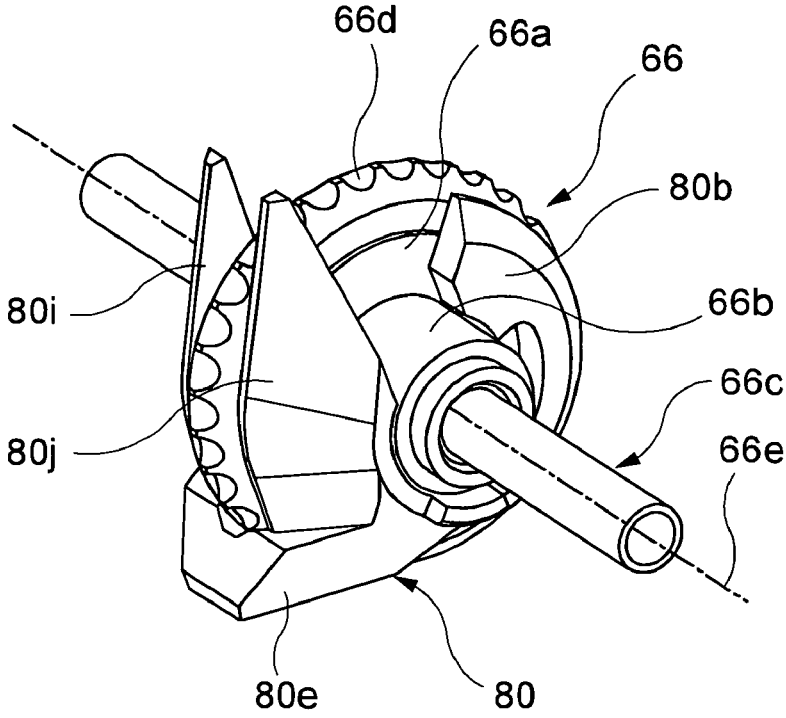
FIG. 5A is an oblique view of the pressure roller and reversing-prevention lever.
Figure 5B:
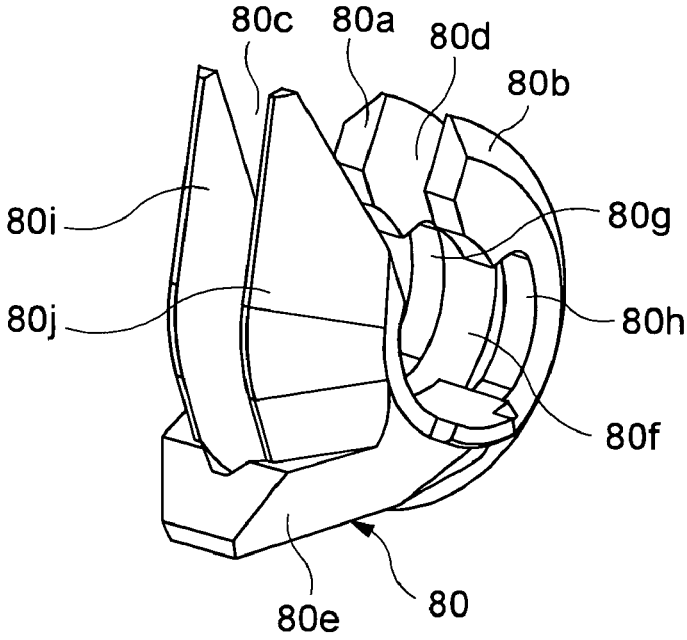
FIG. 5B is an oblique view of the reversing-prevention lever.

FIG. 5A is an oblique view showing the pressure roller 66 and reversing-prevention lever 80, and FIG. 5B is an oblique view showing the reversing-prevention lever 80. The pressure roller 66 has a flat spindle-shaped roller body 66*a*, and a cylindrical bearing 66*b* passing through the center and projecting from both sides of the roller body 66*a*. A rotating shaft 66*c* made from a coil spring is inserted through and rotates freely inside the cylindrical bearing 66*b*. The rotating shaft 66*c* is supported by a support member 81 (see FIG. 3) attached to the chassis top portion 12*a* so that the rotating shaft 66*c* can turn freely. The teeth 66*d* of the roller body 66*a* are pressed with specific force by the rotating shaft 66*c*, which as noted is a coil spring, to the outside surface of the roller units 65*b* of the discharge roller 65.

The reversing-prevention lever 80 has right-left symmetrical annular portions 80*a*, 80*b* disposed coaxially with a specific gap therebetween, and a slit 80*c*, 80*d* opening diagonally upward is formed in each annular portion 80*a*, 80*b*. These annular portions 80*a*, 80*b* are connected at the front lower part thereof, that is, on the downstream side thereof in the paper transportation direction, by the lever portion 80*e*. The gap between the annular portions 80*a*, 80*b* is a pressure roller mounting channel 80*f*.

The pressure roller 66 is installed to this pressure roller mounting channel 80*f* through the slits 80*c*, 80*d* from a direction perpendicular to the axis of rotation 66*e*. When the pressure roller 66 is thus installed, the curved inside surfaces 80*g*, 80*h* of the annular portions 80*a*, 80*b* are supported freely rotationally on the circular outside surface of the cylindrical bearing 66*b* of the pressure roller 66.

More specifically, the reversing-prevention lever 80 is mounted to the pressure roller 66 so that the reversing-prevention lever 80 can rotate freely around the axis of rotation 66*e* of the pressure roller 66. Symmetrical engaging flanges 80*i*, 80*j* are formed at the front part of the annular portions 80*a*, 80*b*. The bottom ends of these flanges 80*i*, 80*j* are connected to the lever portion 80*e*.

A thick lever portion 80*e* and right-left symmetrical flanges 80*i*, 80*j* are thus formed on the front side of the center of the reversing-prevention lever 80. The front part of the reversing-prevention lever 80 is thus heavier than the back portion (the part on the upstream side thereof in the paper transportation direction), and the center of gravity of the reversing-prevention lever 80 is therefore on the front side (that is, the downstream side in the paper transportation direction) of the axis of rotation 66*e*.

As shown in FIG. 3, a rotation-limiting surface 81*b* that can contact the flanges 80*i*, 80*j* when the reversing-prevention lever 80 rotates from the back to front is formed in the vertical portion 81*a* at the front of the support member 81 of the top portion 12*a* to which the reversing-prevention lever 80 (pressure roller 66) is assembled. The reversing-prevention lever 80 cannot rotate further forward after the flanges 80*i*, 80*j* contact the rotation-limiting surface 81*b*, and the reversing-prevention lever 80 is thus held at that rotary position.

Operation of the Reversing-Prevention Lever

Operation of the reversing-prevention lever 80 thus comprised is described next below with reference to FIG. 6A to FIG. 6C. The roll paper 10 loaded in the recording paper holder (not shown) is conveyed by the paper feed roller 62 along the horizontal transportation path, and is printed to by the inkjet head 15 as the paper passes the printing position 83. After printing, the paper is cut by the paper cutting mechanism 67, producing a piece of paper 100 of a particular length. This length of paper 100 is then conveyed by the discharge roller 65 and discharged to the front of the printer.

Figure 6A:
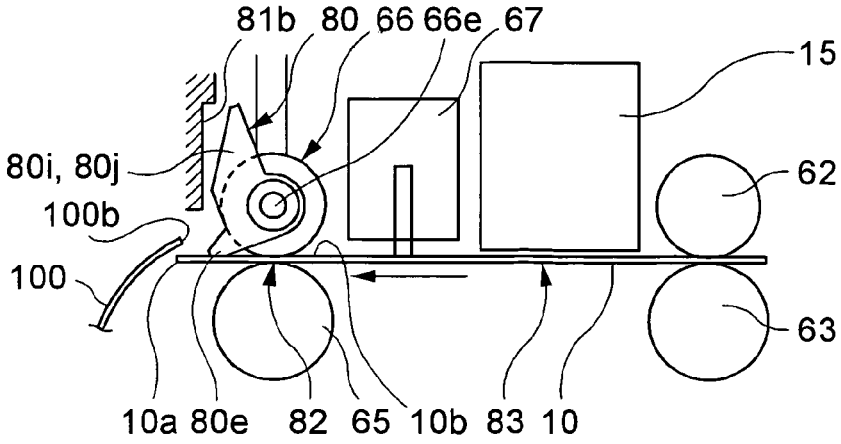
FIG. 6A to FIG. 6C describe the operation of the reversing-prevention lever.
Figure 6B:
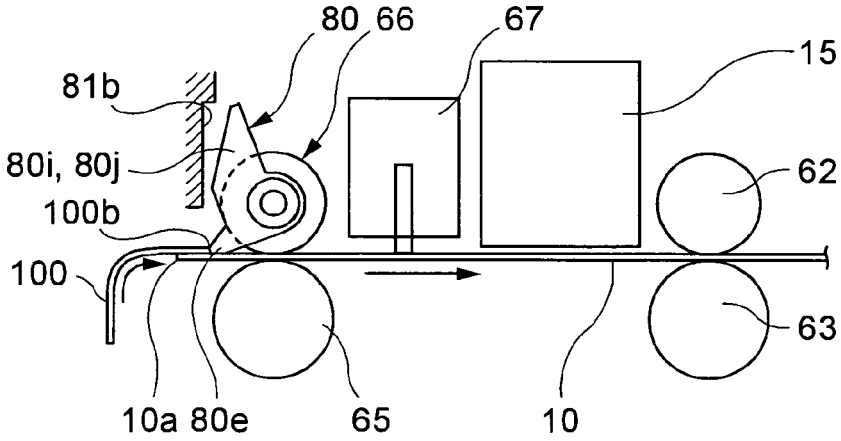
Figure 6C:
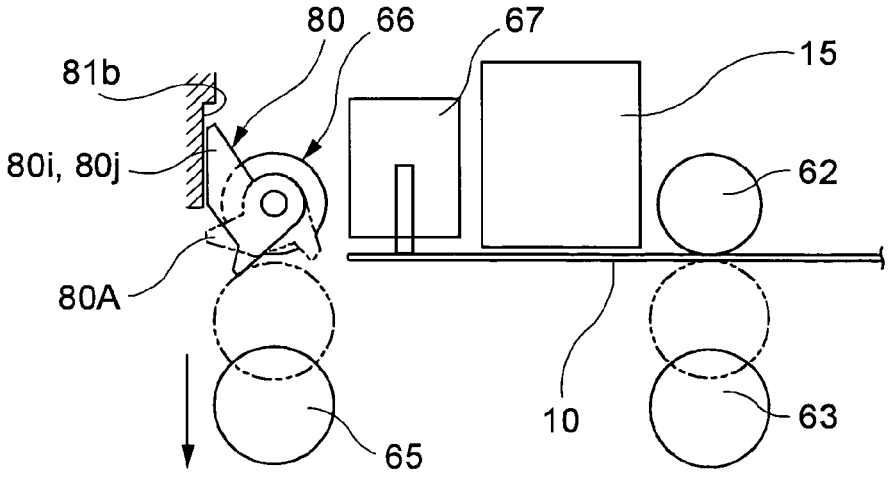

FIG. 6A shows the discharge area of the transportation path after the paper 100 is discharged. The trailing end 100*b* of the paper 100 is positioned at this time downstream from the lever portion 80*e* of the reversing-prevention lever 80. The leading end 10*a* of the trailing roll paper 10 is also exposed from the nipping portion 82 of the discharge roller 65 and pressure roller 66 on the same discharge side of the lever portion 80*e* of the reversing-prevention lever 80. As a result, the distal end of the lever portion 80*e* of the reversing-prevention lever 80 is resting on the top surface 10*b* of the leading end of the paper 10.

The paper feed roller 62 and discharge roller 65 are then reversed to pull the paper 10 back inside the transportation path until the leading end 10*a* of the paper 10 is near the printing position 83. Because the trailing end of the discharged paper 100 is on top of the leading end of the paper 10, the paper 100 may be pulled back inside the printer with the roll paper 10 when the roll paper 10 is wound back into the printer. If the paper 100 resting on top of the roll paper 10 is thus pulled back toward the transportation path, the trailing end 100*b* thereof contacts the end of the lever portion 80*e* of the reversing-prevention lever 80, which rests on the leading end part of the roll paper 10 as shown in FIG. 6B, and is thus prevented from being pulled into the printer. As a result, the paper 10 is pulled from below the paper 100, and the paper 100 drops out. Problems resulting from the discharged paper 100 being nipped by the discharge roller 65 and pulled back inside the printer are thus reliably prevented.

If the roll paper 10 or discharged paper 100 disappears from below the reversing-prevention lever 80, the weight of the reversing-prevention lever 80 causes the lever 80 to rotate down around the axis of rotation 66*e*. However, the reversing-prevention lever 80 stops rotating when the flanges 80*i*, 80*j* meet the rotation-limiting surface 81*b* as shown in FIG. 6C, and the reversing-prevention lever 80 thus does not rotate further. As a result, when the platen lever 9 is depressed and the platen 61 opens, the reversing-prevention lever 80 rotates to the position labelled 80A in FIG. 6C, thereby preventing problems resulting from the reversing-prevention lever 80 rotating to and being positioned on the upstream side in the paper transportation direction when the platen 61 is closed.

Furthermore, because friction from rotation of the pressure roller 66 exerts a force that works to push the reversing-prevention lever 80 up while the paper 10 or paper 100 is conveyed forward, the reversing-prevention lever 80 exerts little resistance to paper transportation in the forward direction. When the paper 10 is pulled back inside, however, the paper 10 is conveyed in reverse while pulling against the reversing-prevention lever 80, and the reversing-prevention lever 80 thus exerts great resistance to paper transportation. As a result, the reversing-prevention lever 80 is reliably held against the surface of the paper 10, thereby reliably preventing the discharged paper 100 from being pulled inside.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

For example, a reversing-prevention lever 80 is disposed to a pressure roller 66 side in the foregoing embodiment, but the invention shall not be so limited as the same effect can be achieved by means of a reversing-prevention lever 80 disposed freely rotationally on a discharge roller 65 side if the pressure roller 66 applies pressure to the discharge roller 65 from below.

What is claimed is:

1. A paper discharge mechanism for use in a printer to control discharge of recording paper from the printer in a downstream direction relative to a location of a recording paper printing position, comprising:

a discharge roller disposed at a position downstream of the recording paper printing position;

a pressure roller mounted for rotation about an axis and configured to press against the discharge roller for advancing the recording paper in the downstream direction or in a reverse, upstream direction; and a lever disposed on the downstream side of the recording paper printing position, the lever being mounted for rotation about the axis of rotation of the pressure roller with the center of gravity of the lever being on the downstream side of the axis of rotation, the lever comprising a channel in which the pressure roller is mounted for rotation, the lever being configured to prevent recording paper from being drawn in the upstream direction.

2. The paper discharge mechanism of claim 1, wherein:

the pressure roller comprises a plurality of roller units mounted for rotation about a common axis along a width dimension of the printer; and the axis of rotation about which the lever is mounted for rotation is the common axis.

3. The paper discharge mechanism of claim 1, further comprising a limiting member disposed adjacent to the lever to limit the degree of rotation of the lever in a given direction.

4. The paper discharge mechanism of claim 2, wherein the lever rotates on account of its own weight and center of gravity toward the limiting member located on the downstream side of the pressure roller.

5. The paper discharge mechanism of claim 3, wherein:

the pressure roller comprises a spindle-shaped roller body, a cylindrical bearing formed in unison with and passing through a center region of the roller body, and a rotating shaft formed of a coil spring and supported by the cylindrical bearing for rotation; and the lever further comprises an inside surface adapted to rotate relative to an outside surface of the cylindrical bearing of the pressure roller, and a contact portion adapted to contact the limiting member at a particular degree of rotation of the lever.

6. A paper discharge mechanism for use in a printer to control discharge of recording paper from the printer in a downstream direction relative to a location of a recording paper printing position, comprising:

a discharge roller pair, including a first roller and a second roller disposed above the first roller in a height dimension of the printer, the discharge roller pair being disposed downstream of the recording paper printing position for advancing recording paper in either the downstream direction or in a reverse, upstream direction; and a lever disposed on the downstream side of the recording paper printing position, the lever being mounted for rotation about an axis of rotation of the first roller with the center of gravity of the lever being on the downstream side of the axis of rotation, the lever comprising a channel in which the first roller is mounted for rotation, the lever being configured to prevent recording paper from being drawn in the upstream direction toward the recording paper printing position.

7. A printer, comprising:

a print head;

a feed roller disposed upstream from a printing position of the print head relative to a paper discharge direction;

a pressure roller configured to press paper against the feed roller;

a paper discharge mechanism comprising a discharge roller pair, including a first roller and a second roller disposed above the first roller in a height dimension of the printer, the discharge roller pair being disposed downstream of the printing position for advancing paper downstream in the paper discharge direction or in a reverse, upstream direction;

a lever disposed on the downstream side of the printing position, the lever being mounted for rotation about an axis of rotation of the first roller with the center of gravity of the lever being on the downstream side of the axis of rotation, the lever comprising a channel in which the first roller is mounted for rotation, the lever being configured to prevent paper from being drawn in the upstream direction toward the printing position; and a paper cutting mechanism disposed between the printing position and the paper discharge mechanism.

* * * * *